United States Patent [19]

Melville

[11] Patent Number: 4,636,330

[45] Date of Patent: Jan. 13, 1987

[54] PERFUME DEPOSITING DETERGENTS CONTAINING PERFUME IN A PARTICULATE MATRIX OF A CATIONIC COMPOUND

[75] Inventor: James B. Melville, Merseyside, England

[73] Assignee: Lever Brothers Company, New York, N.Y.

[21] Appl. No.: 694,896

[22] Filed: Jan. 25, 1985

Related U.S. Application Data

[63] Continuation of Ser. No. 239,837, Mar. 2, 1981, abandoned.

[30] Foreign Application Priority Data

Mar. 11, 1980 [GB] United Kingdom ..... 8008239

[51] Int. Cl.[4] ..... C11D 1/65; C11D 1/86; C11D 3/50; C11D 17/06

[52] U.S. Cl. ..... 252/174.11; 8/115.6; 8/188; 8/137; 252/8.8; 252/90; 252/174; 252/522 A; 252/528; 252/547; 427/393.1

[58] Field of Search ..... 252/8.8, 90, 174, 174.11, 252/528, 547, 522 A; 8/115.6, 137, 188; 427/393.1

[56] References Cited

U.S. PATENT DOCUMENTS

| | | | |
|---|---|---|---|
| 3,154,489 | 10/1964 | Brow et al. | 252/8.75 |
| 3,178,366 | 4/1965 | Brow et al. | 252/8.8 |
| 3,546,115 | 12/1970 | Gill et al. | 252/8.8 |
| 3,790,484 | 2/1974 | Blair | 252/174.11 |
| 3,936,538 | 2/1976 | Marshall et al. | 427/242 |
| 4,134,838 | 6/1979 | Hooper et al. | 252/8.8 |
| 4,151,097 | 4/1979 | Nelson | 252/8.6 |
| 4,152,272 | 5/1979 | Young | 252/8.8 |
| 4,230,590 | 10/1980 | Wixon | 252/97 |
| 4,308,151 | 12/1981 | Cambre | 252/8.8 |

FOREIGN PATENT DOCUMENTS

| | | | |
|---|---|---|---|
| 1544863 | 4/1979 | United Kingdom | 252/8.8 |
| 1560640 | 2/1980 | United Kingdom | 252/174.11 |

*Primary Examiner*—Dennis L. Albrecht

*Attorney, Agent, or Firm*—Milton L. Honig; James J. Farrell

[57] ABSTRACT

A material for depositing perfume on a surface comprises particles having a size of 0.1 to 2000 microns, the particles containing a perfume and a matrix material, the matrix material being a cationic component, optionally together with a nonionic component. When the nonionic component is present the cationic to nonionic ratio is at least 5:1. The particles may be incorporated in a solid or liquid fabric washing detergent composition or hard surface cleaner. Suitable cationic materials include quaternary ammonium compounds. Suitable nonionic materials include esters of polyhydric alcohols, fatty alcohols and derivatives thereof. Compared to products containing the same amount of perfume in the free state, the products of the invention give improved deposition and perfume retention on the treated surfaces.

2 Claims, No Drawings

PERFUME DEPOSITING DETERGENTS CONTAINING PERFUME IN A PARTICULATE MATRIX OF A CATIONIC COMPOUND

This is a continuation application of Ser. No. 239,837, filed Mar. 2, 1981, now abandoned.

TECHNICAL FIELD

This invention relates to a method of depositing perfumes on surfaces. It also relates to compositions for carrying out such a method and to methods of making such compositions. The surfaces which can be treated by the method of the invention include fabrics such as cotton, wool, polyacrylic, polyester and polyamide fibres and hard surfaces such as ceramic, plastics material laminate, metal, wood and glass. The methods are applicable to the treatment of such surfaces both by hand and by machine, such as the machine washing of fabrics.

BACKGROUND ART

It is known to include perfumes in detergent compositions to provide a pleasant after-smell on the treated surfaces. It is desirable to have the perfume component of a detergent composition used efficiently because it is a relatively high cost component. In use, the perfume will be often present in the treatment liquid at a relatively low concentration.

It has been proposed in British Patent Specification No. 1,544,863 to incorporate perfume on a fabric conditioning prill containing nonionic and optionally cationic materials, up to a maximum cationic to nonionic ratio of 5:1, the prills having a size of 5 to 2000 microns. These prills are picked up by the fabrics during washing and thereafter are melted in a laundry dryer to release the perfume.

DISCLOSURE OF THE INVENTION

We have now surprisingly discovered that a perfume benefit can be obtained by incorporating a perfume in particles consisting essentially or predominantly only of cationic particles and that such particles are compatible with detergent active materials usually employed for cleaning surfaces, thereby enabling the cleaning of surfaces and the deposition of perfumes thereon to be carried out in a single step.

According to the invention there is provided a material for depositing perfume on a surface, comprising particles having an average size of from about 0.1 to about 2000 microns, said particles comprising a matrix material and a perfume, characterised in that said particles are an intimate mixture comprising (a) from about 0.5% to about 50% by weight of a perfume component;

(b) from about 22% to about 99.5% by weight of a cationic component; and optionally (c) from about 0% to about 16.6% by weight of a nonionic component, the ratio by weight of the cationic component to the nonionic component, when present, being at least about 5:1.

The perfume carrying amine particles preferably have a size of from about 10 to about 500 microns, most preferably from about 50 to about 200 microns. A mixture of different particle sizes may be used. In particular it may be advantageous to use a mixture of relative smaller particles with relatively larger particles with few, if any, particles of intermediate size.

The amount of perfume in the particles should be between about 0.5% to about 50% by weight based on the weight of the particles, preferably between about 10% and about 30%.

The perfume may be selected from any perfumes and any mixtures thereof. Examples of fabric substantive perfumes suitable for use in the present invention are listed in S Arctander, Perfume Flavors and Chemicals, Volumes I and II, published by the Author, Montclair, N.J., USA and the Merck Index, 8th Edition, Merck & Co. Inc., Rahway; N.J., USA. Deodorant perfumes such as disclosed in U.S. Specification No. 4,134,838 may also be used.

Suitable cationic materials useful in the particles may be water soluble or insoluble and include any of the cationic (including imidazolinium) compounds listed in Morton; U.S. Pat. No. 3,686,025. Such materials are well known in the art and include, for example, the quaternary ammonium salts having at least one, preferably two, $C_{10}$–$C_{20}$ fatty alkyl substituent groups, alkyl imidazolinium salts wherein at least one alkyl group contains a $C_8$–$C_{25}$ carbon "chain"; and the $C_{12}$–$C_{20}$ alkyl pyridinium salts.

Preferred cationic materials herein include the quaternary ammonium salts of the general formula $R^1R^2R^3R^4N^+X^-$, wherein groups $R^1$, $R^2$, $R^3$ and $R^4$ are, for example, alkyl, and $X^-$ is an anion, e.g. halide, or methylsulfate, with the chloride and methylsulfate salts being preferred. Especially preferred cationic components are those wherein $R^1$ and $R^2$ are each substituted or unsubstituted straight or branched chain alkyl or alkenyl groups having 12 to 20 carbon atoms, $R^3$ and $R^4$ are each substituted or unsubstituted alkyl groups having 1 to 4 carbon atoms, and $X^-$ is a univalent anion. The fatty alkyl groups can be mixed, i.e., the mixed $C_{14}C_{18}$ coconutalkyl and mixed $C_{16}$–$C_{18}$ tallowalkyl quaternary compounds. Alkyl groups $R^3$ and $R^4$ are preferably methyl.

Exemplary quaternary cationic materials herein include ditallowalkyldimethylammonium methylsulfate, ditallowalkyldimethylammonium chloride, dicoconutalkyl-di-methylammonium methylsulfate, and dicoconutalkyldimethylammonium chloride.

When the particles contain a nonionic component, this may be a compound or a mixture of compounds selected from esters of polyhydric alcohols, fatty alcohols, and derivatives thereof. Suitable examples include sorbitan tristearate, ethoxylated alcohols and the condensation products of propylene glycol with ethylene oxide. Preferably, the weight ratio of the cationic component to the nonionic component lies between about 6:1 and about 12:1.

Alternatively the particles may contain substantially no nonionic material.

In addition to the cationic material, the perfume and, when present, the nonionic material, the particles may also contain an amine, in particular a water-dispersible amine having the general formula $$R—N—R_1R_2$$

where R is an alkyl or alkenyl group having 8 to 22 carbon atoms, $R_1$ is hydrogen or an alkyl or alkenyl group having 1 to 4 carbon atoms, and $R_2$ is hydrogen or an alkyl or alkenyl or amino-alkyl group having 1 to 22 carbon atoms.

Particular examples of such amines are hardened tallow primary amine, cocoprimary amine, methyl dihardened tallow tertiary amine, eicosanyl-dicocosanyl primary amine and N-alkyl 1:3 propylene diamines, where the alkyl group is hardened tallow, coco or a $C_{18}$–$C_{20}$ mixture.

The invention further provides a number of product forms containing the particles described above. Thus the particles may be incorporated in a solid product, for example a solid particulate product, or they may be incorporated in a liquid product where the particles are suspended in a liquid medium, which may be for example water or a mixture of water with other materials.

The particles may therefore be incorporated in a detergent composition in solid or liquid form. In this case the composition will contain a detergent active material, with or without a builder, the particles and optionally such other materials as are conventionally included in detergent compositions.

A preferred detergent composition will contain from about 5% to about 85% by weight of a detergent active material optionally together with a detergency builder and from about 0.5% to about 30% by weight of the particles.

Preferably the quantity of particles in such a composition is between 0.7% and about 7%.

In products of this type, the detergent active material is preferably selected from anionic, nonionic, zwitterionic and amphoteric detergent active materials and mixtures thereof. Suitable surfactants and builders include those listed in "Surface Active Agents and Detergents", Volumes I and II by Schwartz, Perry & Berch. Preferred detergent active materials include synthetic detergent active materials.

Typical synthetic anionic detergents are the alkyl benzene sulphonates having from 8–16 carbon atoms in the alkyl group, eg sodium dodecyl benzene sulphate; the aliphatic sulphonates, eg $C_8$–$C_{18}$ alkane sulphates; the olefin sulphonates having from 10–20 carbon atoms, obtained by reacting an alpha-olefin with gaseous diluted sulphur trioxide and hydrolysing the resulting product; the alkyl sulphates such as tallow alcohol sulphate; and further the sulphation products of ethoxylates and/or propoxylated fatty alcohols, alkyl phenols with 8–15 carbon atoms in the alkyl group, and fatty acid amines, having 1–8 moles of ethoxylene or propoxylene groups.

Typical nonionic detergents are the condensation productions of alkyl phenols having 5–15 carbon atoms in the alkyl group with ethylene oxide, e.g. the reaction product of nonyl phenol with 6–30 ethylene oxide units; the condensation products of higher fatty alcohols, such as tridecyl alcohol and secondary $C_{10}$–$C_{15}$ alcohols, with ethylene oxide, known under the trade name of "Tergitols" (Registered Trade Mark) supplied by Union Carbide, the condensation products of fatty acid amides with 8–15 ethylene oxide units and the condensation products of polypropylene glycol with ethylene oxide.

Also within the scope of this invention are those products which contain soap as a part of the detergent active material or as the sole detergent active material. Suitable soaps include the alkalimetal salt of fatty acids containing between 10 and 24 carbon atoms. Particular examples are the sodium salts of tallow, coconut, palm oil or rapeseed oil fatty acids.

Suitable builders are weakly acid, neutral or alkaline reacting, inorganic or organic compounds, especially inorganic or organic complex-forming substances, e.g. the bicarbonates, carbonates, borates or silicates of the alkalimetals; the alkalimetal ortho-, meta-, pyro- and tripolyphosphates. Another class of suitable builders are the insoluble sodium aluminosilicates as described in Belgian Patent Specification No. 814,874.

The compositions according to the invention may also include other ingredients conventionally added to detergent compositions, including bleaches, bleach precursors, optical brightening agents, fillers, buffers, antiredeposition agents, preservatives, antifoaming agents, abrasives, thickeners, enzymes, and organic solvents.

Suitable thickeners for the products of the invention include those conventionally used in liquid detergent compositions such as polyethylene oxides, polyethylene glycols, carboxymethyl cellulose, colloidal silica, Carbopol (Registered Trade Mark)—a carboxyvinyl polymer, Natrosol (Registered Trade Mark)—hydroxyethylcellulose and Veegum (Registered Trade Mark)—a modified montmorillonite clay.

Suitable abrasives for use in the products of the invention include calcite, volcanic ash, felspar, quartz, talc and mixtures thereof.

Alternatively, the particles of the invention may be in the form of wash-addable products, that is products for adding to an aqueous composition which already contains other components, such as detergent active materials for treating of the surface. These products may consist of the particles per se, or the particles in combination with solid and/or liquid diluents.

When the particles are in the form of a liquid wash-addable product, this product may comprise a composition containing from about 0.5% to about 50%, preferably about 0.7% to about 7.0%, by weight of particles in an aqueous base. In this case the liquid base will normally be primarily water, but may contain other materials, for example, a fabric conditioning agent such as a cationic material (in addition to the cationic material included in the particles), short chain alcohols, buffering agents to provide a desired pH (the pH should not be so high that the cationic material is converted into a non-cationic form), electrolytes, emulsifiers, colouring materials, perfumes (in addition to the perfume carried on the particles), bactericides and surface active agents.

The present invention also encompasses a method of depositing perfume on a surface, comprising contacting the surface with an aqueous composition containing a perfume, characterised in that the perfume is added to the aqueous composition in the form of from about 0.005 g per liter to about 0.3 g per liter, based on the volume of the aqueous composition of the particles described above. The surface may be treated with the above mentioned aqueous composition in the presence or absence of a detergent active material.

The conditions under which the method of the invention is carried out may vary according to the circumstances, such as whether the surface being treated is a fabric material or a hard surface, the concentration of the aqueous composition, the degree of perfume deposition desired and (where the aqueous composition contains a detergent active material) the nature of the detergent active material and the nature of the soil to be removed from the surface. However, the treatment of surfaces with the aqueous composition for a period from 1 to 60 minutes or more and at a temperature of between 20° C. and 90° C. may be found to be suitable.

As will have been seen from the above, the surface to be treated is contacted with the cationic/perfume particles in the form of an aqueous composition. This composition may be formed in a variety of methods, such as for example adding to water a solid or concentrated liquid composition containing the particles.

As a further alternative, the particles may be added to an aqueous medium already containing a detergent active material. The particles may be added to this medium prior to or simultaneously with the contact between the composition and the surface being treated.

Preferably, the treated surface is dried by allowing water to evaporate therefrom at a temperature below 50° C. Thus, in the case of fabrics, it is preferred to line-dry the fabrics. In the case of treating hard surfaces, the surfaces are preferably allowed to dry without application of heat.

The particles of the invention may be prepared by a variety of methods. Thus, for example, the cationic component and the perfume component are formed into a liquid mixture such as by melting together, which mixture is subsequently transformed into particles of the desired size.

The liquid mixture may be transformed into particles of the desired size by cooling the mixture to a solid, grinding the solid and sieving the resulting particles. Alternatively, the particles may be formed by dispersing the liquid mixture in a liquid medium such as water and optionally separating the particles from the liquid medium. Alternatively, the liquid mixture may be transformed into particles of the desired size by spray drying.

BEST MODE OF CARRYING OUT THE INVENTION

The invention will be further described, purely by way of example, in the following non-limiting Examples.

EXAMPLE 1

19.333 g of Arosurf TA100 was melted and 0.667 g of a perfume added. An intimate mix was formed by stirring and was then allowed to solidify. The solid was ground in a Moulinex coffee grinder together with dry ice to prevent heat build-up. The particles thus formed were then sieved to give various size fractions, the fraction between 50 μm and 200 μm being selected for use.

2 Kg of a mixed synthetic load was washed at 35° C. using 90 g of a conventional detergent composition to which had been added 10 g of particles (to give an effective perfume concentration of about 0.3%). A Miele de Luxe 432 front loading automatic washing machine was used with a 10-liter fill of cold Wirral water, giving a liquor:cloth ratio of 9:1.

After the wash cycle had ended, fabrics were line-dried overnight and assessed for perfume intensity. Comparison was made with a similar load washed in 100 g of detergent to which 0.3 g of perfume had been added by spraying. The results are shown in Table I which quotes the average grading on each type of fabric.

TABLE I

| Fabric | Mean Perfume Intensity Test Product | Control Product |
|---|---|---|
| Bulked Nylon | 0.6 | 0 |
| Nylon Sheeting | 0.4 | 0 |
| Crimplene | 0.7 | 0 |
| Bulked Acrylic | 0.3 | 0 |

It was also found that the perfume retention over a period of time was better in the case of the test product than in the case of the control product.

EXAMPLE 2

17.0 g of Arosurf TA 100 and 2.0 g sorbitan tristearate were melted together and 1.0 g of a perfume added. An intimate mix was formed by stirring and was then allowed to solidify. The solid was ground in a Moulinex coffee grinder together with dry ice to prevent heat build-up. The particles thus formed were then sieved to give various size fractions, the fraction between 50 μm and 200 μm being selected for use.

2 Kg of a mixed synthetic load was washed at 35° C. using 96 g of a conventional detergent composition to which had been added 4 g of particles (to give an effective perfume concentration of 0.2%). A Miele de Luxe 432 front loading automatic washing machine was used with an 18-liter fill of cold Wirral water, giving a liquor:cloth ratio of 9:1.

After the wash cycle had ended, fabrics were line-dried overnight and assessed for perfume intensity. Comparison was made with a similar load of washing in 100 g of detergent to which 0.2 g of perfume had been added by spraying. The results are shown in Table II which quotes the average grading on each type of fabric.

TABLE II

| Fabric | Mean perfume intensity Test Product | Control Product |
|---|---|---|
| Bulked Nylon | 0.4 | 0.1 |
| Crimplene | 0.4 | 0.2 |
| Nylon Sheeting | 0.3 | 0.2 |
| Bulked Acrylic | 0.3 | 0.2 |

The perfume used in Examples 1 and 2 above had the composition disclosed in our co-pending British Patent Application No. 8004106.

The "conventional detergent composition" used in the above Examples had the following approximate composition:

| Ingredient | % by weight |
|---|---|
| Anionic detergent active material | 13 |
| Nonionic detergent active material | 7 |
| Sodium tripolyphosphate | 35 |
| Sodium silicate | 5 |
| Sodium sulphate | 26 |
| Water and minor ingredients | balance |

EXAMPLE 3

Particles comprising 95% Arosurf TA 100 and 5% perfume, prepared using the method described in Example 1 can be incorporated in a general purpose hard surface cleaner having the following approximate composition:

| Ingredient | % by weight |
|---|---|
| Alkyl benzene sulphonate (approx C12) | 2.0 |
| Coconut fatty acid | 1.2 |
| Potassium hydroxide | 0.63 |
| Coconut diethanolamide | 3.5 |
| Sodium tripolyphosphate | 10.0 |
| Particles | 20.0 |
| Water | balance |

EXAMPLE 4

Particles comprising 85% Arosurf TA 100, 10% sorbiton tristearate and 5% perfume, prepared using the method described in Example 2 can be incorporated in a toilet cleaner having the following approximate composition:

| Ingredient | % by weight |
|---|---|
| Alkyl ether sulphate ($C_{12/15}$ 3EO) | 4.0 |
| Alkyl benzene sulphonate | 2.0 |
| Formalin | 0.5 |
| Particles | 10.0 |
| Water | balance |

I claim:

1. A method of depositing perfume on a fabric surface, comprising contacting the surface with an aqueous composition comprising an effective amount for cleaning of an anionic detergent active material and from about 0.005 g/liter to about 0.3 g/liter, based on the volume of the aqueous composition, of particles having an average size of from about 0.1 to about 2,000 microns, said particles comprising a matrix material and a perfume, characterized in that said particles are an intimate mixture comprising:

(a) from about 0.5% to about 50% by weight of a perfume component;

(b) from about 22% to about 99.5% by weight of a cationic component; and optionally (c) from about 0% to about 16.6% by weight of a nonionic component;

the ratio by weight of the cationic to the nonionic component, when present, being at least 5:1;

and wherein the fabric is dried by line drying.

2. A method of depositing perfume on a fabric surface, comprising contacting the surface with an aqueous composition comprising an effective amount for cleaning of an anionic detergent active material and from about 0.005 g/liter to about 0.3 g/liter, based on the volume of the aqueous composition, of particles having an average size of from about 0.1 to about 2,000 microns, said particles comprising a matrix material and a perfume, characterized in that said particles are an intimate mixture comprising:

(a) from about 0.5% to about 50% by weight of a perfume component;

(b) from about 22% to about 99.5% by weight of a cationic component; and optionally (c) from about 0% to about 16.6% by weight of a nonionic component;

the ratio by weight of the cationic component to the nonionic component ranging from about 6:1 to about 12:1;

and wherein the fabric is dried by line drying.

* * * * *